US009428922B2

(12) United States Patent
Silk et al.

(10) Patent No.: US 9,428,922 B2
(45) Date of Patent: Aug. 30, 2016

(54) APPARATUS PROVIDING VISUAL-REVEAL GAP FOR WALL

(71) Applicant: FOREST VIEW INDUSTRIES LTD., Mississauga (CA)

(72) Inventors: Mark Silk, Mississauga (CA); Steve McElwee, Mississauga (CA)

(73) Assignee: Forest View Industries Ltd., Mississauga (CA)

( * ) Notice: Subject to any disclaimer, the term of this patent is extended or adjusted under 35 U.S.C. 154(b) by 33 days.

(21) Appl. No.: 14/514,495

(22) Filed: Oct. 15, 2014

(65) Prior Publication Data

US 2015/0107174 A1 Apr. 23, 2015

Related U.S. Application Data

(60) Provisional application No. 61/892,846, filed on Oct. 18, 2013, provisional application No. 61/906,548, filed on Nov. 20, 2013.

(51) Int. Cl.
*E04F 19/06* (2006.01)
*E04F 13/06* (2006.01)

(52) U.S. Cl.
CPC ..... *E04F 19/061* (2013.01); *E04F 13/06* (2013.01)

(58) Field of Classification Search
CPC ..... E04F 13/00; E04F 13/06; E04F 13/04; E04F 13/081; E04F 19/00; E04F 19/02; E04F 19/022; E04F 19/04; E04F 19/0454; E04F 19/0459; E04F 19/0463; E04F 19/0468; E04F 19/0481; E04F 19/0486; E04F 19/06; E04F 19/061; E04F 19/066
See application file for complete search history.

(56) References Cited

U.S. PATENT DOCUMENTS

| | | | | |
|---|---|---|---|---|
| 2,203,119 A * | 6/1940 | Wollaeger | ..... | 52/718.02 |
| 2,872,162 A | 2/1959 | Marini | | |
| 2,876,691 A | 3/1959 | Woods | | |
| 2,993,978 A | 7/1961 | Markel et al. | | |

(Continued)

FOREIGN PATENT DOCUMENTS

| | | |
|---|---|---|
| CN | 201268935 | 7/2009 |
| JP | 3171358 B2 | 5/2001 |

(Continued)

*Primary Examiner* — Jessica Laux
(74) *Attorney, Agent, or Firm* — Miltons IP/p.i.

(57) ABSTRACT

Apparatus includes body assembly configured for installation to wall assembly and baseboard. Visual-reveal feature is formed between body assembly and baseboard once body assembly and baseboard are positioned, body assembly is installed to wall-support structure that abuts against and supports weight of wall assembly, and baseboard is installed to body assembly. Body assembly includes wall-support contact portion configured for positioning adjacent to wall-support structure. First engagement assembly extends from wall-support contact portion. Second engagement assembly is configured to attach to baseboard. Second engagement assembly and first engagement assembly are configured to engage with each other. Body assembly also includes wall-contact portion configured to contact outer wall surface of wall assembly. Finished-edge portion extends from wall-contact portion. Finished-edge portion is configured for positioning proximate to wall edge of wall assembly. Visual-reveal feature is positioned between baseboard edge of baseboard and wall edge of wall assembly. Visual-reveal feature includes channel having vertical height and horizontal depth.

13 Claims, 6 Drawing Sheets

(56) References Cited

U.S. PATENT DOCUMENTS

| | | | | |
|---|---|---|---|---|
| 3,051,816 | A | 8/1962 | Knoll et al. | |
| 3,137,785 | A | 6/1964 | Norton | |
| 3,286,422 | A * | 11/1966 | Pangerl | 52/288.1 |
| 4,565,041 | A * | 1/1986 | Wendt | 52/288.1 |
| 5,243,800 | A * | 9/1993 | Olbrich | 52/287.1 |
| 5,598,681 | A * | 2/1997 | DiGianni | 52/717.05 |
| 6,191,363 | B1 * | 2/2001 | Samuels | 174/68.3 |
| 6,729,087 | B2 * | 5/2004 | Sauter | 52/290 |
| 2010/0242389 | A1 * | 9/2010 | DePaul | 52/288.1 |
| 2011/0108318 | A1 * | 5/2011 | Pawlak | 174/504 |
| 2011/0179733 | A1 * | 7/2011 | Picken | 52/242 |
| 2013/0091791 | A1 * | 4/2013 | Hardy | 52/288.1 |

FOREIGN PATENT DOCUMENTS

| | | | |
|---|---|---|---|
| JP | 2002004563 | | 1/2002 |
| JP | 3790341 | B2 | 6/2006 |
| JP | 2007231558 | | 9/2007 |
| JP | 2010270509 | A | 12/2010 |

* cited by examiner

APPARATUS PROVIDING VISUAL-REVEAL GAP FOR WALL

TECHNICAL FIELD

Some aspects are generally related to (and are not limited to) architectural components. More specifically, some aspects provide an architectural component (or a decorative component) configured to provide a visual feature to a wall, such as an apparatus providing a visual-reveal feature.

BACKGROUND

Interior architectural design or exterior architectural design involves turning an interior space or an exterior space into a setting for the range of human activities that are to take place inside or outside a building.

SUMMARY

A problem associated with wall design (and example of an architectural component) was researched. After much study, an understanding of the problem and its solution has been identified.

There are some wall-design requirements for installing a visual-reveal feature to (in or on) a wall. Known systems for accommodating such a requirement are difficult to manage and facilitate in such a way as to ensure an aesthetic outcome that is satisfactory.

In order to mitigate (at least in part) at least one problem associated with existing architectural designs, there is provided (in accordance with a major aspect) an apparatus. The apparatus is for a baseboard that is installable relative to a wall assembly supported by a wall-support structure. The apparatus includes a body assembly configured for installation relative to the wall assembly and the baseboard. A visual-reveal feature is formed between the body assembly and the baseboard once (A) the body assembly and the baseboard are positioned relative to each other, (B) the body assembly is installed to the wall assembly, and (C) the baseboard is installed to the wall assembly. The body assembly includes a wall-support contact portion configured to contact (at least in part) the wall-support structure. A first engagement assembly extends from the wall-support contact portion. A second engagement assembly is configured to be attachable to the baseboard. The second engagement assembly and the first engagement assembly are configured to engage with each other.

Other aspects are identified in the claims.

Other aspects and features of the non-limiting embodiments may now become apparent to those skilled in the art upon review of the following detailed description of the non-limiting embodiments with the accompanying drawings.

DETAILED DESCRIPTION OF THE DRAWINGS

The non-limiting embodiments may be more fully appreciated by reference to the following detailed description of the non-limiting embodiments when taken in conjunction with the accompanying drawings, in which.

Figure 1A:
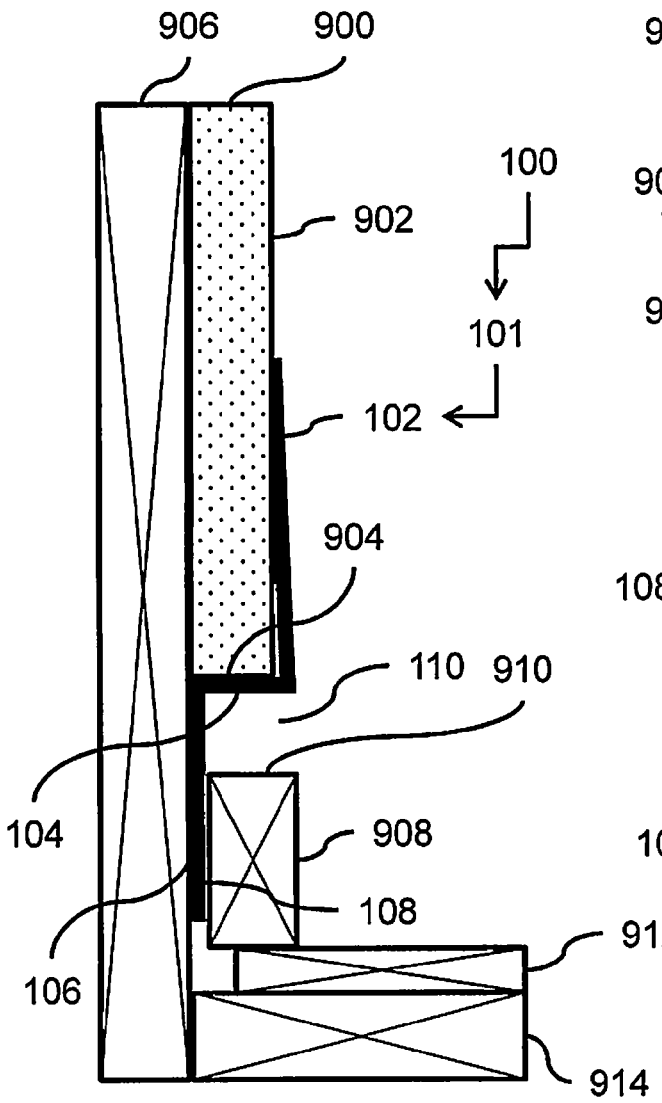
FIG. 1A (SHEET 1 of 6 SHEETS) depicts a schematic representation of a cross-sectional view of an example of an apparatus as installed.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. In addition, common, but well-understood, elements that are useful or necessary in commercially feasible embodiments are often not depicted in order to facilitate a less obstructed view of the various embodiments of the present disclosure.

LISTING OF REFERENCE NUMERALS USED IN THE DRAWINGS

100 apparatus
101 body assembly
102 wall-contact portion
104 finished-edge portion
106 wall-support contact portion
108 baseboard-contact portion
110 visual-reveal feature
112 body-connector assembly
114 groove assembly
116 lip portion
118 offset section
120 second engagement assembly
122 baseboard-connector assembly
124 baseboard-connector body
126 first engagement mechanism
128 first engagement assembly
130 connector finger
132 floor extension portion
134 weakness line
135 perforation
136 protection portion
138 horizontal portion
140 nib
142 floor-extension portion
144 extended-walled section
146 connection portion
900 wall assembly
902 outer wall surface
904 wall edge
906 wall-support structure
908 baseboard

910 baseboard edge
912 finish floor
913 baseboard plane
914 sub-floor
915 top surface

DETAILED DESCRIPTION OF THE NON-LIMITING EMBODIMENT(S)

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of the description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also understood that the specific devices and processes illustrated in the attached drawings, and described in the following specification, are simply exemplary embodiments (examples), aspects and/or concepts defined in the appended claims. Hence, specific dimensions and other physical characteristics relating to the embodiments disclosed herein are not to be considered as limiting, unless the claims expressly state otherwise. It is understood that the phrase "at least one" is equivalent to "a".

FIG. 1A (SHEET 1/5) depicts a schematic representation of a cross-sectional view of an example of an apparatus 100 as installed. In accordance with a general aspect, the apparatus 100 includes a body assembly 101 for installation relative to a wall assembly 900 and a baseboard 908. A visual-reveal feature 110 is formed between the apparatus 100 (the body assembly 101) and the baseboard 908.

In accordance with a more specific general aspect, the apparatus 100 includes (and is not limited to) the baseboard 908 is installable relative to the wall assembly 900. The body assembly 101 includes (and is not limited to) a visual-reveal feature 110. The visual-reveal feature 110 may include a relief, a gap, a pattern, a groove, a channel, etc. (and any equivalent thereof). The visual-reveal feature 110 may be called a reveal section. The visual-reveal feature 110 is formed and located between the body assembly 101 and the baseboard 908. The visual-reveal feature 110 is formed once the body assembly 101 and the baseboard 908 are positioned relative to each other. The visual-reveal feature 110 is formed once the baseboard 908 is installed relative to the wall assembly 900. The visual-reveal feature 110 is a feature that adds and/or improves the esthetic value (design interest) to the wall assembly 900 and/or to the wall-support structure 906 and/or to the wall edge 904, or to other aspects of the wall assembly 900. In accordance with an option (if so desired), there is no material (such as a flashing element) inserted or extending into (or extending out from) the visual-reveal feature 110.

In accordance with a specific (detailed) aspect, the apparatus 100 is adapted from the general aspect in the following manner: the body assembly 101 has a finished-edge portion 104. The finished-edge portion 104 is configured to contact, at least in part, a wall edge 904 of the wall assembly 900 (if so desired). It will be appreciated that a gap, such as a nominal (approximate) 0.25 inch gap, may exist between the finished-edge portion 104 and the wall edge 904 (if so desired), in which case the finished-edge portion 104 is positioned proximate to (or adjacent to at least in part) the wall edge 904. The body assembly 101 contacts the wall-support structure 906 (for the case where the wall-support structure 906 includes a stud wall). The body assembly 101 also has a baseboard-contact portion 108. The baseboard-contact portion 108 is configured to contact, at least in part, a decorative side 911 of the baseboard 908 and/or to pass by, at least in part, a baseboard edge 910 of the baseboard 908. The finished-edge portion 104 and the baseboard edge 910 of the baseboard 908 are positioned relative to each other to form, at least in part, the visual-reveal feature 110. More specifically, the baseboard edge 910 is spaced apart from the finished-edge portion 104.

In accordance with a more specific (detailed) option, the apparatus 100 is adapted from the general aspect in the following way: the body assembly 101 has a wall-contact portion 102. The wall-contact portion 102 is configured to contact, at least in part, the outer wall surface 902 of the wall assembly 900. The finished-edge portion 104 extends, at least in part, from the wall-contact portion 102. The finished-edge portion 104 is configured to be positioned proximate to (or to contact, at least in part) the wall edge 904 of the wall assembly 900. It will be appreciated that the finished-edge portion 104 does not have to make contact the wall edge 904 (if so desired). The body assembly 101 also has a wall-support contact portion 106. The wall-support contact portion 106 is configured to be positioned relative to (positioned proximate to, or to contact at least in part) a wall-support structure 906.

The body assembly 101 is also called a profile or a trim assembly. The body assembly 101 may include an extruded plastic body (also called an extrusion) formed by an extrusion machine by using an extrusion process (known and not disclosed here). The body assembly 101 includes an extruded profile, which may be made from PVC (Polyvinyl Chloride) and any equivalent thereof. The apparatus 100 may be manufactured to have PVC and/or any comparable material and/or any material suitable for the process used to manufacture the body assembly 101. Extrusion is a process used to create objects of a fixed cross-sectional profile. A material is pushed or drawn through a die having a desired cross-section. In this manner, complex cross-sections may be created. The extrusion (extrusion profile) formed by the extrusion machine may be continuous (producing relatively longer pieces) or semi-continuous (producing many relatively smaller pieces). Examples of extruded materials may include metals, polymers, ceramics, or concrete, etc.

The wall assembly 900 is a side of a room or a building. The wall assembly 900 extends generally vertically. The wall assembly 900 may connect a floor component with a ceiling component (or a foundation and a roof) of a living space (such as a residential and/or commercial building). For instance, the wall assembly 900 may include a drywall. Drywall is also known as plasterboard, wallboard, gypsum board, or gyprock. Drywall is a panel made of gypsum plaster pressed between two thick sheets of paper. Drywall is used to make (form) interior walls and ceilings. Drywall construction became prevalent as a speedier alternative to traditional lath and plaster techniques.

The wall edge 904 of the wall assembly 900 may be called a wall bottom section, a lower edge and/or a bottom edge of the wall assembly 900. The wall edge 904 is positioned proximate to, but offset from, a finish floor 912 as depicted in FIG. 1A.

The wall-support structure 906 is a structure configured to abut against the wall assembly 900, and/or to support, at least in part, the weight of the wall assembly 900. The wall assembly 900 may be fixedly attached to the wall-support structure 906. The wall-support structure 906 may be a load-bearing structure (bearing structure) configured to bear a load resting upon it by transmitting the received weight to a foundation structure and/or to other walls or separate rooms). As well, the wall-support structure 906 may be a non-load bearing structure. The materials that may be used to construct a load-bearing structure are concrete, block, brick and/or wood. By way of example, the wall-support structure 906 may include a stud wall. The stud wall is a vertical member used in light-frame construction techniques called platform framing of a wall of a building. The wall-support structure 906 may be called a rough wall.

In accordance with an option, the apparatus 100 is provided (sold) with the baseboard 908 pre-installed. In accordance with another option, the apparatus 100 may be sold separately from the baseboard 908 (that is, sold by different vendors).

Figure 1B:
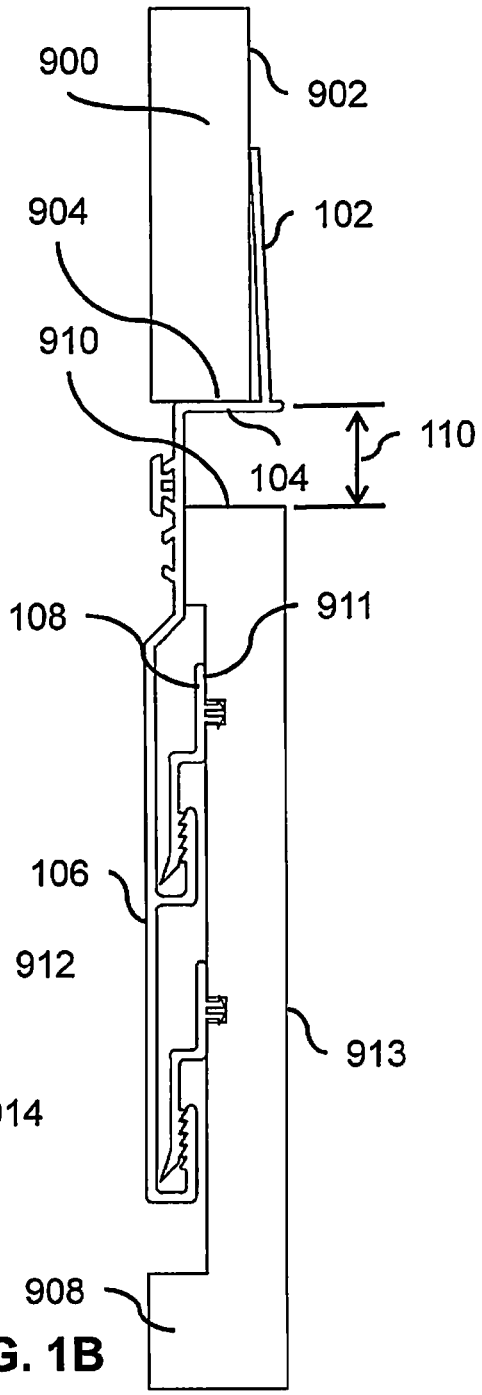
FIG. 1B (SHEET 1 of 6 SHEETS) depicts a cross-sectional view of an example of the apparatus of FIG. 1A.

The baseboard 908 is also called a decorative assembly, a skirting board, skirting, a mopboard, floor molding, as well as a base molding. The baseboard 908 may be made of wood, plastic or any suitable material. The apparatus 100 may allow for taller instances of the baseboard 908. As depicted in FIG. 1A and FIG. 1B, the baseboard 908 is positioned on the finish floor 912. The finish floor 912 is positioned on a sub-floor 914.

FIG. 1B (SHEET 1/5) depicts a cross-sectional view of an example of the apparatus 100 of FIG. 1A, in which additional structural details of the apparatus 100 are depicted.

Referring to FIG. 1A, for the embodiment depicted, the wall-support structure 906 (such as a stud wall) is installed. The sub-floor 914 is installed. Then, the wall assembly 900 (such as a drywall) is installed to (connected to) the wall-support structure 906; then, the finish floor 912 is installed over the sub-floor 914. The finish floor 912 does not touch the wall-support structure 906, and this arrangement allows for expansion and contraction of the finish floor 912. The finish floor 912 is set back from the wall-support structure 906, so that a wall gap is defined between the edge of the finish floor 912 and the wall-support structure 906; the wall gap is configured to permit expansion and contraction of the finish floor 912 (such as wooded floors). The body assembly 101 (which may be called a profile) is installed to (connected to) the wall-support structure 906, between the bottom of the wall assembly 900 and above the sub-floor 914. The lower section of the body assembly 101 does not touch the sub-floor 914 (for the embodiment depicted). The baseboard 908 (such as a baseboard) is installed to (connected to) the body assembly 101. The baseboard 908 abuts the top of the finish floor 912.

The body assembly 101 has a predetermined thickness. In accordance with an option (not depicted), the apparatus 100 may include the body assembly 101 having a predetermined thickness (depth). The apparatus 100 also may include a thickness-extension section (not depicted) having a predetermined thickness. The thickness-extension section is attachable (such as glued, connected or snap fit) to the body assembly 101. The thickness-extension section is configured to make up for a variation in the thickness of the wall assembly 900. For instance, the wall assembly 900 may include drywall panels. For the case where the installed drywall panels have about a 0.5 inch thickness, the thickness-extension section is not required. For the case where the installed drywall panels have about a ⅝ inch thickness, the thickness-extension section provides an additional ⅛ inch (approximately) to the body assembly 101. This is done in order to make up for the shortfall (if so desired). In this manner the baseboard 908 may then be installed such that the outer facing surface of the baseboard 908 may be positioned vertically in-line with the outer wall surface 902 of the wall assembly 900.

The apparatus 100 is installed such that the baseboard 908 has a baseboard plane 913 that is generally vertically in-line with the outer wall surface 902 of the wall assembly 900. As well, the apparatus 100 is configured to provide the visual-reveal feature 110 that is substantially consistent in the height or dimension between the baseboard edge 910 of the baseboard 908 and the wall edge 904 (wall bottom) of the wall assembly 900. The apparatus 100 is formed with the finished-edge portion 104 that abuts (contacts or is positioned proximate to) the wall edge 904 of the wall assembly 900. The finished-edge portion 104 covers (or shields) the wall edge 904 (bottom edge) of the wall assembly 900. The wall edge 904 may be called a cut raw drywall edge of the wall assembly 900. Preferably, the baseboard plane 913 of the baseboard 908 is aligned in-line (coplanar) with the outer plane of the wall assembly 900 once the wall assembly 900 is finished with a drywall compound (such as mud compound). The apparatus 100 forms a finished edge (with the help of the finished-edge portion 104) that abuts (contacts or is positioned proximate to) the wall edge 904 of the wall assembly 900. In this manner, the cut raw edge (the wall edge 904) of the drywall (the wall assembly 900) is covered, and this arrangement provides a substantially consistent-looking bottom edge (the finished-edge portion 104) for the wall assembly 900.

In accordance with an option, the body assembly 101 is configured to include the strength component (not depicted). The strength component may (for instance) resist flexing for the case where a nail is used to attach the body assembly 101 to the wall-support structure 906. Alternatively, the strength component includes (defines) channels configured to permit passage of a nail without imparting stress to the body assembly 101 for the case where as the nails or connectors are used to fasten the body assembly 101 to the wall-support structure 906.

In summary, the apparatus 100 is configured to: (A) finish the wall edge 904 of the wall assembly 900, and (B) keep the baseboard edge 910 the baseboard 908 at a consistent distance from (spaced apart from) the wall edge 904 (such as the bottom of the drywall edge) of the wall assembly 900. In this manner or arrangement, the dimension of the visual-reveal feature 110 is consistent (for aesthetic purposes as may be required for an interior-design application). The apparatus 100 is configured to keep the appearance of the wall edge 904 of the wall assembly 900 looking like a straight line (preferably a near-perfect line) with the help of the finished-edge portion 104 of the body assembly 101.

FIGS. 2A, 2B, 2C, and 2D (SHEET 2/5) depict exploded views of the apparatus 100 of FIG. 1B. These FIGS. depict the detailed views of the cross-sections of the body assembly 101.

Figure 2A:
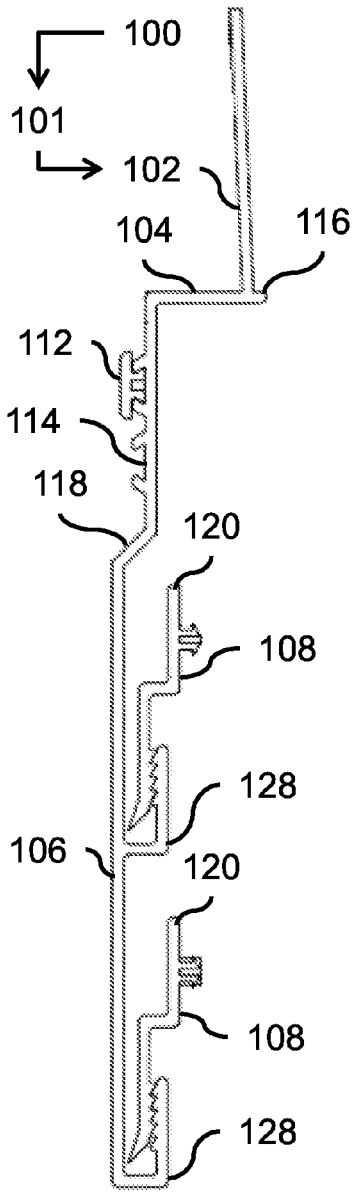
FIGS. 2A, 2B, 2C, 2D and 2E (SHEETS 2 and 3 of 6 SHEETS) depict exploded views of the apparatus of FIG. 1B.
Figure 2B:
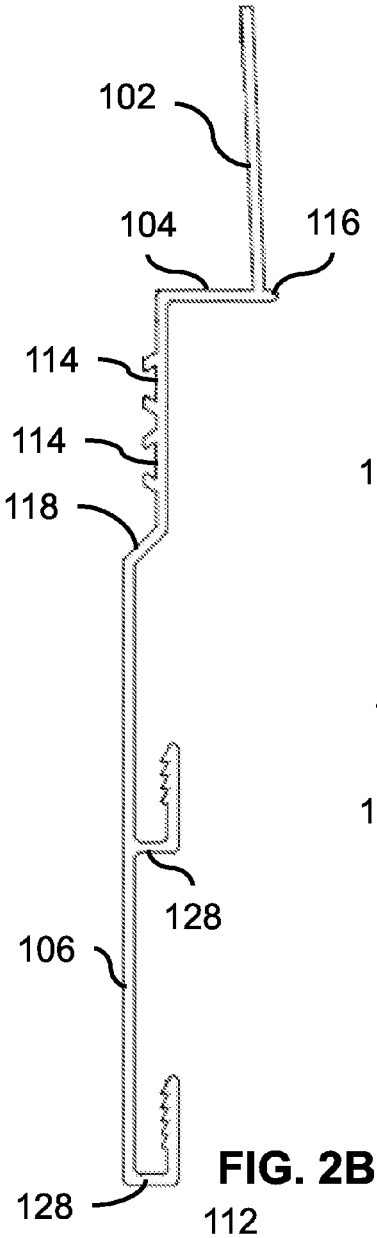

Referring to FIG. 2A and FIG. 2B, the wall-contact portion 102 has a tapered portion or a flared portion, as an option for the case where the wall assembly 900 includes drywall (in which a mud component is to be applied) and/or any equivalent thereof. The tapered portion is configured to accommodate the application of the mud compound and tape to be applied to the wall assembly 900 for the case where the wall assembly 900 includes a drywall. Specifically, some of the mud compound and/or tape materials may be placed over the wall-contact portion 102. A lip portion 116 extends outwardly from the finished-edge portion 104 where the finished-edge portion 104 meets up with the wall-contact portion 102. That way, when a skilled trades person applies the mud compound, there can be a clean edge where the finished-edge portion 104 meets up with the wall-contact portion 102. The lip portion 116 provides a barrier that acts as a clean edge for where the mud compound may rest against once the mud compound is applied to the wall-contact portion 102.

The finished-edge portion 104 provides a horizontally aligned surface for the case where the finished-edge portion 104 is installed as depicted in FIG. 1A and in FIG. 1B. It will be appreciated that if so desired, the finished-edge portion 104 may be aligned non-horizontally, to add additional aesthetic interest to the wall assembly 900 (if so desired).

Figure 2D:
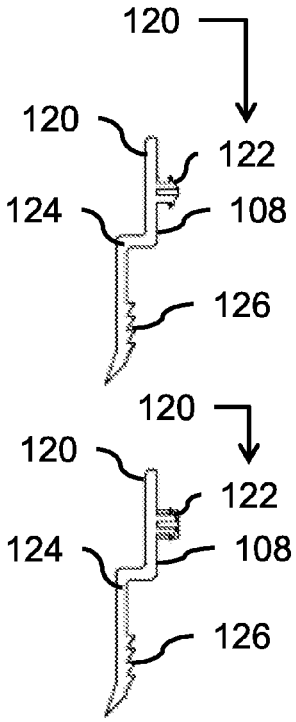
Figure 2C:
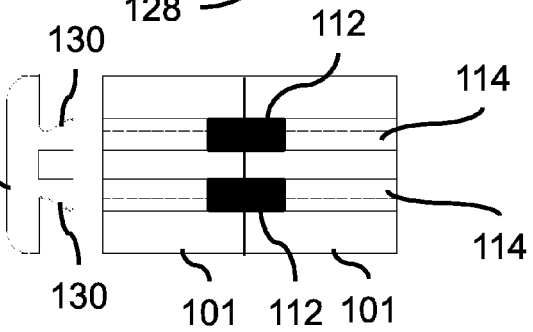

Referring to FIG. 2C, for the case where instances of the body assembly 101 are to be connected on an edge-to-edge basis, a body-connector assembly 112 is provided. Generally, the body-connector assembly 112 is configured to facilitate edge-to-edge connection between side-by-side instances of the body assembly 101 that abut each other on an edge-to-edge basis (end-to-end basis). As depicted, two instances of a groove assembly 114 are formed in (defined by) the body assembly 101, and are spaced apart from each other, and are aligned parallel to each other. An instance of the body-connector assembly 112 is installed in co-aligned instances of the groove assembly 114 formed by two edge-to-edge positioned instances of the body assembly 101 (two neighboring instances of the body assembly 101). The instances of the groove assembly 114 that are positioned on each instance of the body assembly 101 are coaxially aligned with each other. The groove assembly 114 is positioned below the finished-edge portion 104 and below the wall-contact portion 102. The body-connector assembly 112 is configured to be securely received in the groove assembly 114. FIG. 2A depicts the body-connector assembly 112 securely received (installed) in the groove assembly 114. FIG. 2B depicts the body-connector assembly 112 not received (installed) in the groove assembly 114. In accordance with an option (as depicted), the body-connector assembly 112 includes instances of a connector finger 130 (depicted in FIG. 2C) that are spaced apart from each other. The instances of the connector finger 130 extend from the body-connector assembly 112. The instances of the connector finger 130 are configured to be snap fitted into the groove assembly 114 (in a secure fashion as depicted in FIG. 2C).

Referring to FIG. 2C, the body-connector assembly 112 (two instances are depicted) are configured to span across and to align two adjoining instances of the body assembly 101. In this manner, the wall edge 904 of the body assembly 101 may remain substantially aligned along a relatively long distance. This is done in such a way that there are no distractions from any disjointed look or steps in the instances of the body assembly 101 (positioned edge-to-edge) once the instances of the body assembly 101 are connected by the instances of the body-connector assembly 112. The connected instances of the body assembly 101 then form the finished-edge portion 104 as an uninterrupted continuous line (a line without interruptions from one end to the other end). This arrangement provides an aesthetically pleasing effect for occupants of the room in which the apparatus 100 is installed. There is formed a consistent (uniform) spacing between the baseboard edge 910 of the baseboard 908 (FIG. 1B) and the finished-edge portion 104. The finished-edge portion 104 forms a finished line of the wall edge 904 of the wall assembly 900 (as depicted in FIG. 1A).

Referring to FIG. 2A and FIG. 2B, an offset section 118 is positioned between the finished-edge portion 104 and the wall-support contact portion 106. The offset section 118 transitions the alignment of the wall-support contact portion 106. This is done in such a way that the body-connector assembly 112 may be installed in the groove assembly 114 without the body-connector assembly 112 interfering with the wall-support structure 906 of FIG. 1A and FIG. 1B. In this manner, the outer edge of the body-connector assembly 112 may abut the wall-support structure 906 (if so desired). Specifically, the groove assembly 114 is positioned between the finished-edge portion 104 and the offset section 118 as depicted in FIG. 2A and FIG. 2B.

Referring to FIG. 2B, a first engagement assembly 128 extends from the wall-support contact portion 106. As depicted, there are two instances of the first engagement assembly 128 extending from the wall-support contact portion 106. A second engagement assembly 120 is configured to be attached to the baseboard 908 of FIG. 1A and FIG. 1B on the decorative side 911. The second engagement assembly 120 and the first engagement assembly 128 are configured to engably clip together in a locked engagement. The baseboard-contact portion 108 is provided by the second engagement assembly 120 and/or the first engagement assembly 128. The second engagement assembly 120 is configured to engage the first engagement assembly 128.

Referring to FIG. 2D, there is depicted a detailed view of the second engagement assembly 120. The second engagement assembly 120 includes instances of a baseboard-connector assembly 122 configured to connect to the baseboard 908 of FIG. 1B; the baseboard 908 defines a groove or an opening configured to receive the baseboard-connector assembly 122 in a fixed and secure manner (such as snap fitting) so that the baseboard-connector assembly 122.

For installation, the following steps may be used: the body assembly 101 may be installed to (connected to) the wall-support structure 906 (depicted in FIG. 1A). Then, the baseboard-connector assembly 122 of the second engagement assembly 120 is installed to (connected to) the baseboard 908 (depicted in FIG. 1B) at the decorative side 911. The second engagement assembly 120 (connected to the baseboard 908) is then connected (connectable) to the first engagement assembly 128 extending from wall-support contact portion 106.

A baseboard-connector body 124 extends from the baseboard-connector assembly 122 toward a first engagement mechanism 126. The first engagement mechanism 126 may include a row of engagement teeth (as depicted). The first engagement mechanism 126 is configured to engage the first engagement assembly 128. The second engagement assembly 120 may include corresponding engagement teeth that are securely engageable with the engagement teeth of the first engagement mechanism 126. Instances of the second engagement assembly 120 are installed to (connected to) the baseboard 908; then the baseboard 908 is manually positioned in such a way that the corresponding instances of the first engagement mechanism 126 may connectably engage respective instances of the second engagement assembly 120 as depicted in FIG. 1B. The first engagement mechanism 126 and the second engagement assembly 120 may be called U-shaped clips. The first engagement mechanism 126 and the second engagement assembly 120 are configured to facilitate variation in height of the baseboard 908 as may be required.

The body assembly 101 is configured to allow the user (installer) to attach the apparatus 100 to the wall assembly 900 (depicted in FIG. 1A) without requiring the installation of nails through the face of the baseboard 908 (if so desired).

In view of the foregoing, the apparatus 100 is for the baseboard 908. The baseboard 908 is installable relative to the wall assembly 900. The wall assembly 900 is supported by the wall-support structure 906. The apparatus 100 includes the body assembly 101 configured for installation relative to the wall assembly 900 and the baseboard 908. The apparatus 100 also includes the visual-reveal feature 110 formed between the body assembly 101 and the baseboard 908. This is done once: (A) the body assembly 101 and the baseboard 908 are positioned relative to each other, (B) the body assembly 101 is installed to the wall assembly 900, and (C) the baseboard 908 is installed to the wall assembly 900. The body assembly 101 includes the wall-support contact portion 106 configured to contact the wall-support structure 906. The body assembly 101 also includes the first engagement assembly 128 extending from the wall-support contact portion 106. The body assembly 101 also includes the second engagement assembly 120 configured to be attachable to the baseboard 908. The second engagement assembly 120 and the first engagement assembly 128 configured to engage with each other.

In accordance with an embodiment, the apparatus 100 is adapted such that the second engagement assembly 120 and the first engagement assembly 128 are configured to selectively attachably engage and detachably disengage with each other.

In accordance with an embodiment, the apparatus 100 is further adapted such that the second engagement assembly 120 includes the baseboard-connector assembly 122 configured to securely connect to the baseboard 908.

In accordance with an embodiment, the apparatus 100 is further adapted such that the second engagement assembly 120 is configured to be: (A) connectable to the baseboard 908, and (B) connectable to the first engagement assembly 128 extending from the wall-support contact portion 106.

In accordance with an embodiment, the apparatus 100 is further adapted such that the baseboard-connector body 124 extends from the baseboard-connector assembly 122 toward the first engagement mechanism 126, and the first engagement mechanism 126 is configured to engage the first engagement assembly 128.

In accordance with an embodiment, the apparatus 100 is further adapted such that the first engagement mechanism 126 includes the first row of engagement teeth. The second engagement assembly 120 includes the second row of engagement teeth configured to securely engage with the first row of engagement teeth of the first engagement mechanism 126.

In accordance with an embodiment, the apparatus 100 is further adapted such that the second engagement assembly 120 is configured to be connectable to the baseboard 908. The baseboard 908 is positionable in such a way that the first engagement mechanism 126 is engageable with the second engagement assembly 120.

In accordance with an embodiment, the apparatus 100 is further adapted such that the first engagement mechanism 126 includes the first U-shaped clip. The second engagement assembly 120 includes the second U-shaped clip configured to selectively connect with the first U-shaped clip.

In accordance with an embodiment, the apparatus 100 is further adapted such that the first engagement mechanism 126 and the second engagement assembly 120 are configured to facilitate vertical positioning of the baseboard 908.

Figure 2E:
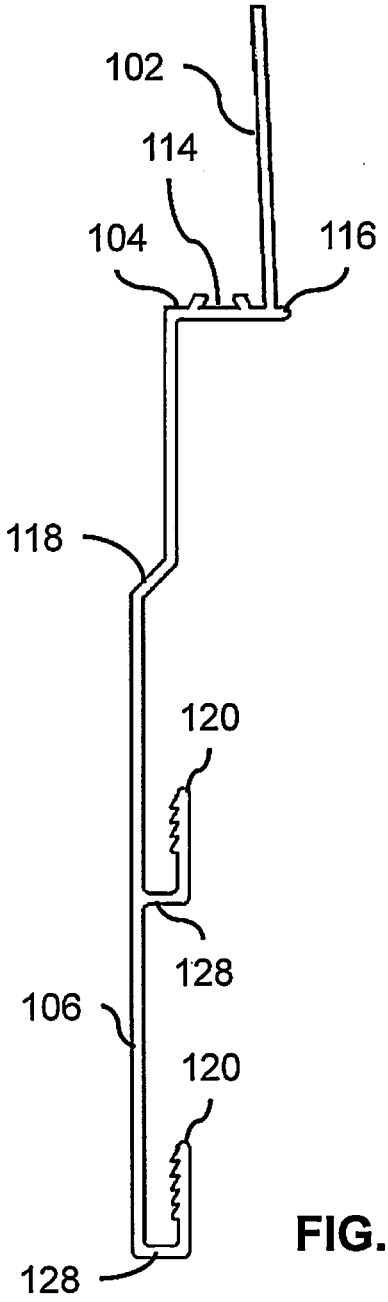

Referring to FIG. 2E, the groove assembly 114 is positioned on the finished-edge portion 104 (as an alternative to the embodiment depicted in FIG. 2B). As an option, the embodiments of FIGS. 2B and 2E may be combined to provide instances of the groove assembly 114 positioned on the finished-edge portion 104 and the wall-support contact portion 106.

Figure 3A:
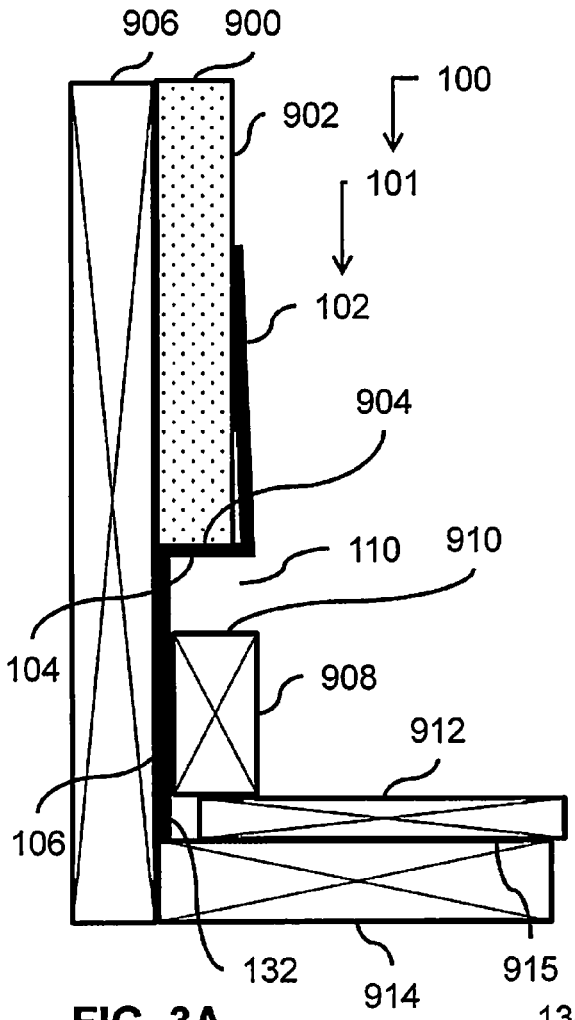
FIG. 3A (SHEET 4 of 6 SHEETS) depicts a schematic representation of a cross-sectional view of an example of the apparatus of FIG. 1A.

FIG. 3A (SHEET 3/5) depicts a schematic representation of a cross-sectional view of an example of the apparatus 100 of FIG. 1A.

Figure 3B:
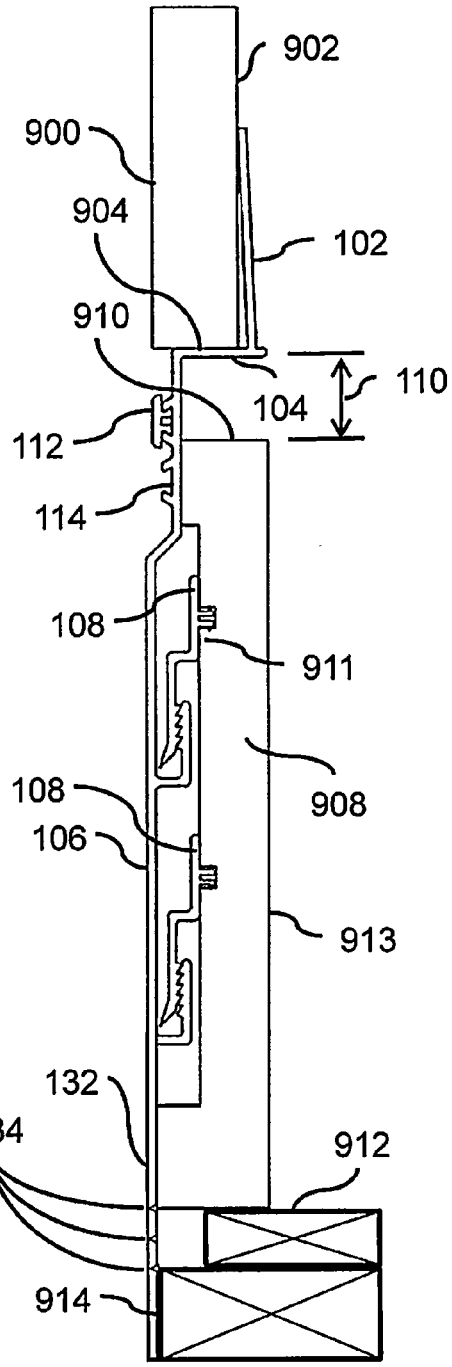
FIG. 3B (SHEET 4 of 6 SHEETS) depicts a cross-sectional view of an example of the apparatus of FIG. 3A.

FIG. 3B (SHEET 3/5) depicts a cross-sectional view of an example of the apparatus 100 of FIG. 3A.

For the embodiment depicted in FIG. 3A, the body assembly 101 includes a floor extension portion 132 that extends from the wall-support contact portion 106. The body assembly 101 is installed to (connected to) the outer wall surface 902 of the wall assembly 900. Then, the floor extension portion 132 extends from the body assembly 101 and abuts (contacts) the sub-floor 914. For this case, the sub-floor 914 is installed perfectly level (horizontal) so that the sub-floor 914 acts as a reference from which the wall assembly 900 may be installed relative to a top surface 915 of the sub-floor 914. The top surface 915 is also called a top of the sub-floor 914. Now the body assembly 101 may contact (and fit between) the wall edge 904 of the wall assembly 900 and the top surface 915 of the sub-floor 914. The thickness of the floor extension portion 132 may be the same thickness as the wall-support contact portion 106, and/or of the rest of the extrusion portions of the body assembly 101 (as depicted in FIG. 3B).

Referring to FIG. 3B, in accordance with an option, the floor extension portion 132 defines (forms or provides) a weakness line 134. The weakness line 134 may be called a groove or notch. The weakness line 134 is configured to allow a user (the installer of the apparatus 100) to remove a section or material portion from the floor extension portion 132 in such a way that the body assembly 101 may be installed in accordance with the embodiment depicted in FIG. 1A and in FIG. 1B (of so desired).

According to an option, the floor extension portion 132 may provide several instances of the weakness line 134, in which each instance is spaced apart from the other instances of the weakness line 134 (along a length of the floor extension portion 132). For the case where the user (installer) is required to install the apparatus 100 in which the user needs to accommodate the wall assembly 900 to be positioned at a predetermined height from the sub-floor 914, the user has the option to remove material from the floor extension portion 132 by selecting a desired instance of the weakness line 134 (if so desired).

In summary, the floor extension portion 132 is configured for the case where the sub-floor 914 is dead level, then the body assembly 101 is placed onto (and contacts) the sub-floor 914. For the case where the sub-floor 914 is not level, the weakness line 134 of the floor extension portion 132 may be used to break off a portion of the floor extension portion 132 (for non-level floor situations).

In view of the foregoing, in accordance with an embodiment, the apparatus 100 is further adapted such that the body assembly 101 includes the floor extension portion 132 extending from the wall-support contact portion 106.

In accordance with an embodiment, the apparatus 100 is further adapted such that the body assembly 101 is configured to be installed to the outer wall surface 902 of the wall assembly 900 in such a way that the floor extension portion 132 extends from the body assembly 101 toward the sub-floor 914.

In accordance with an embodiment, the apparatus 100 is further adapted such that the floor extension portion 132 is configured to provide the weakness line 134, and the weakness line 134 is configured to facilitate removal of the section of the floor extension portion 132. This is done in such a way that the body assembly 101 is installable to the sub-floor 914 once the section of the floor extension portion 132 is removed from the floor extension portion 132.

In accordance with an embodiment, the apparatus 100 is further adapted such that the sub-floor 914 is installed horizontally level so that the sub-floor 914 acts as a reference from which the wall assembly 900 is installed relative to the top surface 915 of the sub-floor 914.

In accordance with an embodiment, the apparatus 100 is further adapted such that the body assembly 101 is configured to fit between the wall edge 904 of the wall assembly 900 and the top surface 915 of the sub-floor 914.

In accordance with an embodiment, the apparatus 100 is further adapted such that the floor extension portion 132 and the wall-support contact portion 106 each have the same thickness.

Figure 4:
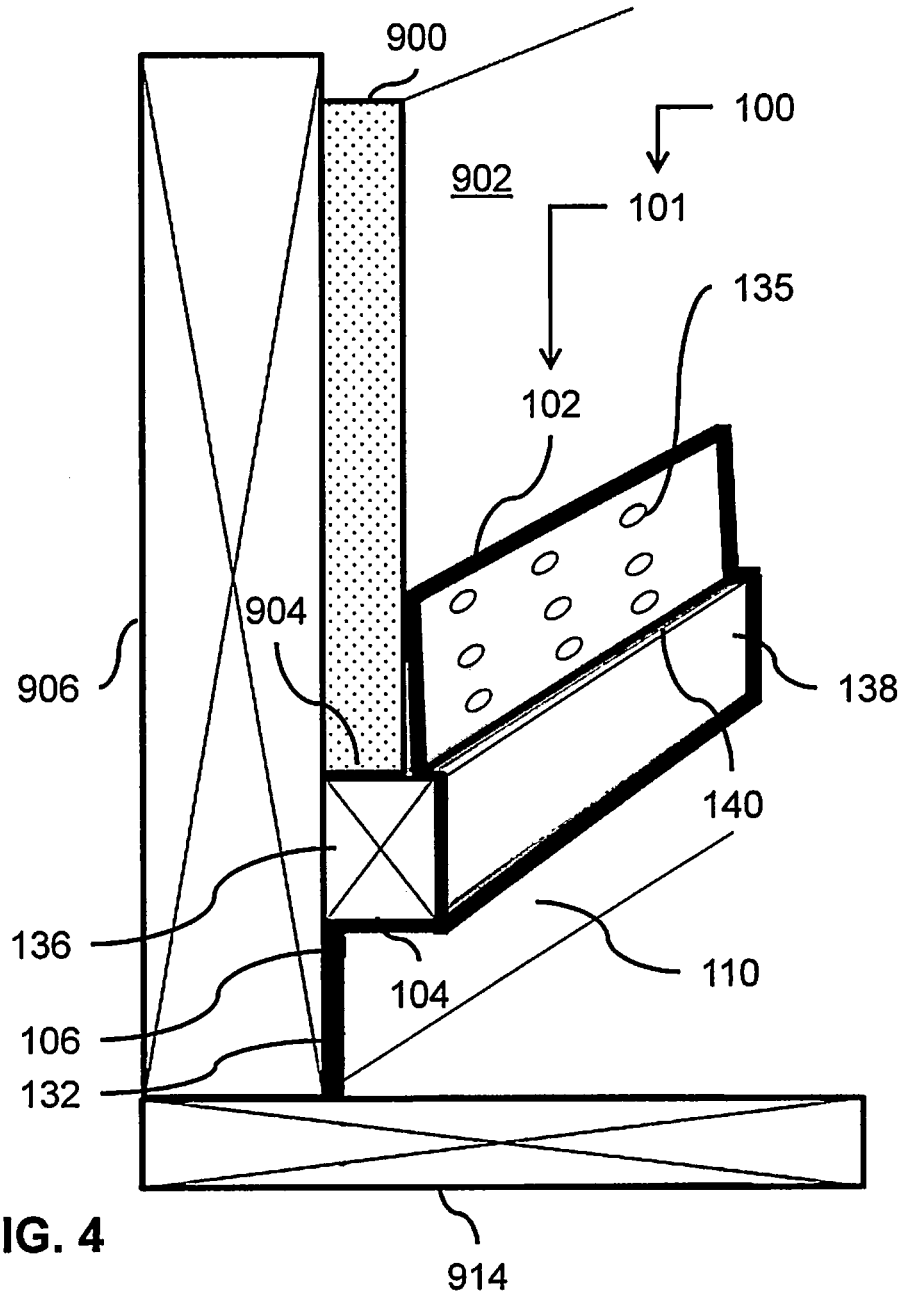
FIG. 4 (SHEET 5 of 6 SHEETS) depicts a schematic representation of a cross-sectional view of an example of the apparatus of FIG. 1A.

FIG. 4 (SHEET 4/5) depicts a schematic representation of a cross-sectional view of an example of the apparatus 100 of FIG. 1A. The baseboard 908 is not installed to the body assembly 101 (as an option if so desired). To improve the clarity of the items depicted in FIG. 4, the finish floor 912 of FIG. 1A is not depicted in FIG. 4. It is understood that the finish floor 912 is to be installed in FIG. 4. The visual-reveal feature 110 is formed between the finished-edge portion 104 and the top of the finish floor 912 once the finish floor 912 is installed onto the sub-floor 914.

The wall-contact portion 102 defines a collection (matrix) of spaced-apart instances of a perforation 135. The perforation 135 may be called a channel or a hole. After the user (installer) has installed the apparatus 100, the user then may apply compound material (also known as mud compound) and wall tape (compound tape) to the outer wall surface 902 of the wall assembly 900. This is done in such a way that the mud compound may be spread over the wall-contact portion 102 and into the instances of the perforation 135. The perforation 135 allows the mud compound to become infused, at least in part, with the wall-contact portion 102, so that the perforation 135 assists with improving the strength of the mud compound placed over the wall-contact portion 102. The perforation 135 may pass through the wall-contact portion 102 (if so desired).

In accordance with another option, a protection portion 136 is attached to the body assembly 101, along a longitudinal length of the body assembly 101. The protection portion 136 is positioned between the finished-edge portion 104 and the wall edge 904. The protection portion 136 is configured to reduce the possibility of inadvertent damage to the wall edge 904 (and surrounding wall portion) of the wall assembly 900.

For instance, when a user of the room vacuums or moves furniture, these actions may easily damage the wall edge 904 of the wall assembly 900. The protection portion 136 is added to the body assembly 101, and is configured to guard the wall edge 904 thus reducing the possibility of inadvertent damage to the wall edge 904. The protection portion 136 may be a wood piece (extra material and any equivalent thereof) positioned inside the body assembly 101. The body assembly 101 forms a horizontal portion 138 leading to a nib 140. The nib 140 may be called a drywall mudding edge or a ledge portion. The nib 140 leads to the wall-contact portion 102. The horizontal portion 138 extends horizontally from the finished-edge portion 104 (if so desired). The horizontal portion 138 may form or have any desired shape if desired.

It will be appreciated that the apparatus 100 may be configured for installation near the ceiling area of the room in such a way as to provide the visual-reveal feature 110 near the ceiling area of the room (if so desired).

In accordance with an option, the apparatus 100 of FIG. 4 does not include the first engagement mechanism 126 and the second engagement assembly 120 of FIG. 2A, FIG. 2B and FIG. 2D (if so desired). In accordance with an option, the apparatus 100 of FIG. 4 includes the weakness line 134 depicted in FIG. 3B.

Figure 5A:
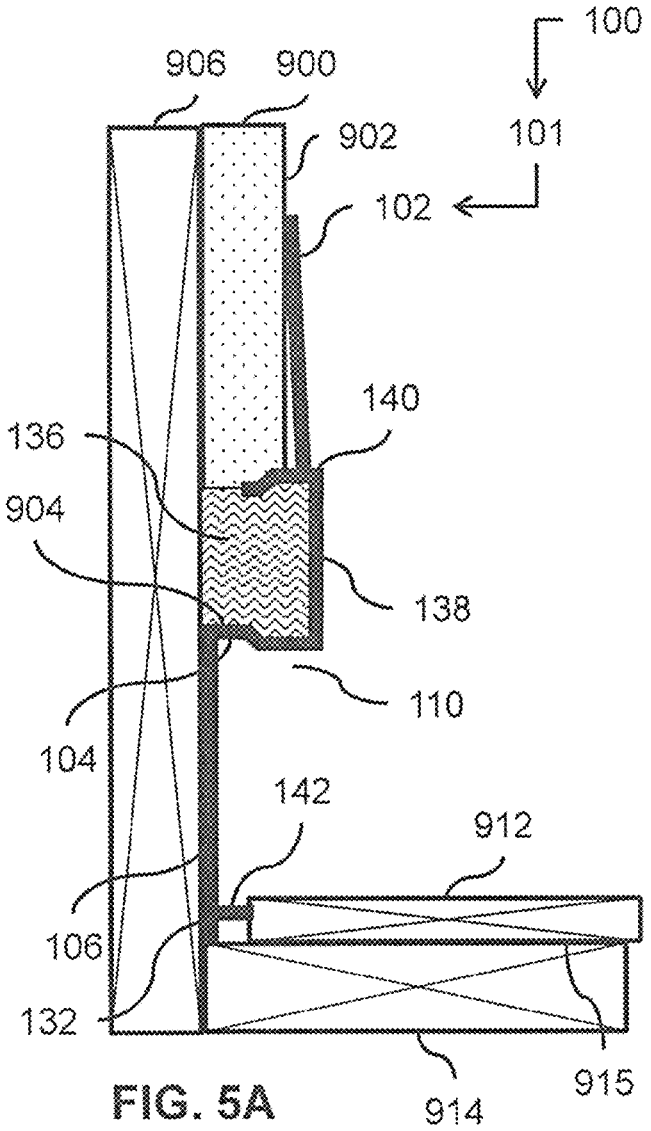
FIGS. 5A, 5B and 5C (SHEET 6 of 6 SHEETS) depict a schematic representation of a side view of an example of the apparatus of FIG. 1A.
Figure 5B:
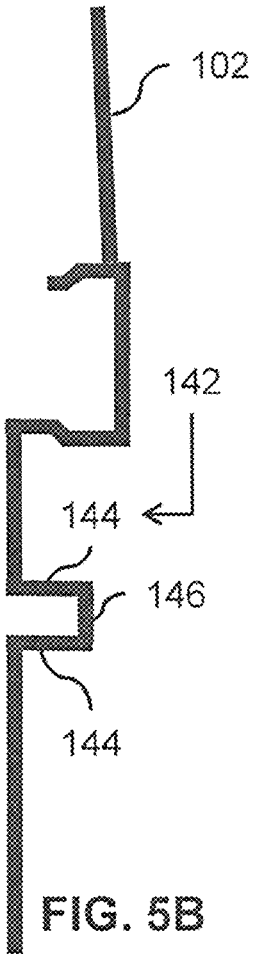
Figure 5C:
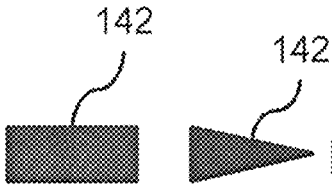

FIGS. 5A, 5B and 5C (SHEET 5/5) depict a schematic representation of a side view of an example of the apparatus of FIG. 1A.

In accordance with FIG. 5A, the wall-support contact portion 106 includes a floor-extension portion 142 that extends from the wall-support contact portion 106 of the apparatus 100. The floor-extension portion 142 extends toward the finish floor 912 (once the finish floor 912 is installed as depicted). The floor-extension portion 142 abuts the side section of the finish floor 912 (once the finish floor 912 is installed onto the sub-floor 914). In this manner, unwanted debris (dust and/or dirt) is prevented from reaching and accumulating on the sub-floor 914 the space between the sub-floor 914 and the wall-support structure 906; thus the floor-extension portion 142 permits improved floor maintenance (and floor hygiene) for the finish floor 912. As depicted in FIG. 5A, the horizontal portion 138 is configured to facilitate snap fit with the protection portion 136 to a side of the horizontal portion 138. Snap fit may include press fit and/or interference fit, etc. The horizontal portion 138 is configured to conform to an outer surface of the protection portion 136 (if so desired). The reason for the jogs placed in the protection portion 136 is to provide a firm fit and/or hold before the glue (placed between the protection portion 136 and the apparatus 100) is allowed to dry in order to facilitate a fixed connection between the protection portion 136 and the apparatus 100. It will be appreciated that the size (vertical height and horizontal depth) of the reveal 110 may be adjusted as desired. It will be appreciated that the size (vertical height and horizontal depth) of the reveal 110 may be adjusted to accommodate for different thickness of the wall assembly 900, such as from about 0.5 inches to about 0.625 inches thickness of drywall, double layer, etc. As well, the thickness of the protection portion (136) may vary depending on the geometry of the wall assembly 900.

FIG. 5B depicts an example of a profile of the floor-extension portion 142. The floor-extension portion 142 includes at least two instances of an extended-walled section 144 that each extend horizontally (or in a non-horizontal alignment or in an askew alignment) from the wall-support contact portion 106 of the apparatus 100 toward the finish floor 912 (once the finish floor 912 is installed). The instances of the floor-extension portion 142 are spaced apart from each other. A connection portion 146 connects the end sections of the instances of the floor-extension portion 142. The connection portion 146 is configured to abut the finish floor 912 once the finish floor 912 is installed on the sub-floor 914, and once the apparatus 100 is installed as depicted in FIG. 5A.

FIG. 5C depicts examples of the profiles of the floor-extension portion 142. The floor-extension portion 142 may include a horizontally-extending planar surface, and/or may include a extending sloped-surface configured to slope toward the finish floor 912 when (A) once the floor-extension portion 142 is positioned relatively higher than the finish floor 912 (if so desired), and (B) once the floor-extension portion 142 abuts the finish floor 912 once the finish floor 912 is installed on the sub-floor 914 (as depicted in FIG. 5A).

In view of the foregoing, in accordance with an embodiment, the apparatus 100 is further adapted such that the wall-support contact portion 106 includes the floor-extension portion 142 extending from the wall-support contact portion 106. The floor-extension portion 142 is configured to abut the finish floor 912. This is done in such a way that unwanted debris is prevented from reaching and accumulating on the sub-floor 914 in the space between the sub-floor 914 and the wall-support structure 906.

In accordance with an embodiment, the apparatus 100 is further adapted such that the body assembly 101 includes the wall-contact portion 102 configured to contact, at least in part, the outer wall surface 902 of the wall assembly 900. The wall-contact portion 102 defines the collection of spaced-apart instances of the perforation 135 each configured to allow the compound wall material to become infused, at least in part, with the wall-contact portion 102. This is done in such a way that once the compound wall material infuses with the wall-contact portion 102, the compound wall material improves strength of the compound wall material placed over the wall-contact portion 102 and the outer wall surface 902 of the wall assembly 900.

In accordance with an embodiment, the apparatus 100 is further adapted such that the collection of spaced-apart instances of the perforation 135 extends through the wall-contact portion 102.

In accordance with an embodiment, the apparatus 100 is further adapted such that the collection of spaced-apart instances of the perforation 135 is configured to: (A) receive the compound wall material, and (B) permit the compound wall material to extend through the wall-contact portion 102 and contact the outer wall surface 902 of the wall assembly 900.

In accordance with an embodiment, the apparatus 100 is further adapted such that the body assembly 101 includes the finished-edge portion 104 and the wall-contact portion 102. The wall-contact portion 102 is configured to contact, at least in part, the wall assembly 900. The body assembly 101 also includes the lip portion 116 extending outwardly from the finished-edge portion 104 where the finished-edge portion 104 meets up with the wall-contact portion 102. This is done in such a way that the lip portion 116 provides the barrier that acts as the clean edge for where the compound wall material may rest against once the compound wall material is applied to the wall-contact portion 102.

It may be appreciated that the assemblies and modules described above may be connected with each other as may be required to perform desired functions and tasks that are within the scope of persons of skill in the art to make such combinations and permutations without having to describe each and every one of them in explicit terms. There is no particular assembly, or components that are superior to any of the equivalents available to the art. There is no particular mode of practicing the disclosed subject matter that is superior to others, so long as the functions may be performed. The crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for the purposes of this document, that the phrase "includes" is equivalent to the word "comprising." It is noted that the foregoing has outlined the non-limiting embodiments (examples). The description is made for particular non-limiting embodiments (examples). It is understood that the non-limiting embodiments are merely illustrative as examples.

What is claimed is:

1. An apparatus for a baseboard being installable relative to a wall assembly being supported by a wall-support structure, the apparatus comprising:

a body assembly being configured for installation relative to the wall assembly and the baseboard; and a visual-reveal feature being formed between the body assembly and the baseboard once: (A) the body assembly and the baseboard are positioned relative to each other, (B) the body assembly is installed to the wall-support structure, and (C) the baseboard is installed to the body assembly; and the body assembly including:

a wall-support contact portion being configured to be positioned adjacent to, at least in part, the wall-support structure;

a first engagement assembly extending from the wall-support contact portion; and a second engagement assembly being configured to be attachable to the baseboard; and the second engagement assembly and the first engagement assembly being configured to engage with each other; and wherein:

the body assembly also includes:

a wall-contact portion being configured to contact, at least in part, the outer wall surface of the wall assembly; and a finished-edge portion extending, at least in part, from the wall-contact portion, and the finished-edge portion being configured to be positioned proximate to a wall edge of the wall assembly; and the visual-reveal feature is positioned between a baseboard edge of the baseboard and the wall edge of the wall assembly; and the visual-reveal feature includes a channel having a vertical height and a horizontal depth; and the visual-reveal feature is substantially consistent in dimension between the baseboard edge of the baseboard and the wall edge of the wall assembly; and the size of the visual-reveal feature is adjustable; and wherein the channel of the visual-reveal feature is visible to an observer once the body assembly is mounted to the outer wall surface of the wall assembly.

2. The apparatus of claim 1, wherein:

the second engagement assembly and the first engagement assembly are configured to selectively attachably engage with and detachably disengage from each other.

3. The apparatus of claim 2, wherein:

the second engagement assembly includes:

a baseboard-connector assembly being configured to securely connect to the baseboard.

4. The apparatus of claim 3, wherein:

the second engagement assembly is configured to be:

connectable to the baseboard; and connectable to the first engagement assembly extending from the wall-support contact portion.

5. The apparatus of claim 3, wherein:

the baseboard-connector assembly extends toward a first engagement mechanism, and the first engagement mechanism is configured to engage the first engagement assembly.

6. The apparatus of claim 5, wherein:

the first engagement mechanism includes a first row of engagement teeth; and the second engagement assembly includes a second row of engagement teeth configured to securely engage with the first row of engagement teeth of the first engagement mechanism.

7. The apparatus of claim 5, wherein:

the second engagement assembly is configured to be connectable to the baseboard; and the baseboard is positionable in such a way that the first engagement mechanism is engageable with the first engagement assembly.

8. The apparatus of claim 5, wherein:

the first engagement mechanism includes a first U-shaped clip; and the first engagement assembly includes a second U-shaped clip configured to selectively connect with the first U-shaped clip.

9. The apparatus of claim 5, wherein:

the first engagement mechanism and the second engagement assembly are configured to facilitate vertical positioning of the baseboard.

10. The apparatus of claim 1, wherein:

the wall-contact portion defines a collection of spaced-apart instances of a perforation each being configured to allow a compound wall material to become infused, at least in part, with the wall-contact portion in such a way that once the compound wall material, in use, infuses with the wall-contact portion, the compound wall material improves strength of the compound wall material placed over the wall-contact portion and the outer wall surface of the wall assembly.

11. The apparatus of claim 10, wherein:

the collection of spaced-apart instances of the perforation extends through the wall-contact portion.

12. The apparatus of claim 10, wherein:

the collection of spaced-apart instances of the perforation is configured to:

receive the compound wall material; and permit the compound wall material to extend through the wall-contact portion and contact the outer wall surface of the wall assembly.

13. The apparatus of claim 1, wherein:

the body assembly further includes:

a lip portion extending outwardly from the finished-edge portion where the finished-edge portion meets up with the wall-contact portion in such a way that the lip portion provides a barrier that acts as a clean edge for where a compound wall material may rest against once the compound wall material is applied to the wall-contact portion.

* * * * *